US008480252B2

(12) United States Patent
Bertram et al.

(10) Patent No.: US 8,480,252 B2
(45) Date of Patent: Jul. 9, 2013

(54) ILLUMINATION DEVICE

(75) Inventors: Ralph Bertram, Nittendorf (DE); Simon Schwalenberg, Donaustauf (DE); Benjamin Jobst, Nittenau (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 251 days.

(21) Appl. No.: 12/999,065

(22) PCT Filed: Jul. 7, 2009

(86) PCT No.: PCT/EP2009/004889

§ 371 (c)(1),
(2), (4) Date: Dec. 15, 2010

(87) PCT Pub. No.: WO2010/003626

PCT Pub. Date: Jan. 14, 2010

(65) Prior Publication Data

US 2011/0090671 A1 Apr. 21, 2011

(30) Foreign Application Priority Data

Jul. 7, 2008 (DE) ..... 10 2008 031 987

(51) Int. Cl.
*F21V 13/00* (2006.01)

(52) U.S. Cl.
USPC ..... 362/243; 362/84; 362/240; 362/249.06; 362/342

(58) Field of Classification Search
USPC ..... 362/84, 240, 243, 294, 342, 545, 362/555, 800, 249.02, 249.06
See application file for complete search history.

(56) References Cited

U.S. PATENT DOCUMENTS

| | | | |
|---|---|---|---|
| 5,662,403 | A | 9/1997 | Akashi et al. |
| 5,924,785 | A | 7/1999 | Zhang et al. |
| 6,857,763 | B2 | 2/2005 | Keller |
| 7,312,927 | B2 | 12/2007 | Bogner et al. |
| 2002/0024808 | A1 | 2/2002 | Suehiro et al. |
| 2002/0136025 | A1 | 9/2002 | Zhang |
| 2004/0001344 | A1 | 1/2004 | Hecht |
| 2006/0072314 | A1 | 4/2006 | Rains |

(Continued)

FOREIGN PATENT DOCUMENTS

| | | | |
|---|---|---|---|
| CN | 1128333 | A | 8/1996 |
| CN | 1698202 | A | 11/2005 |

(Continued)

OTHER PUBLICATIONS

English abstract of KR 20030067449 A, May 12, 2011.

(Continued)

*Primary Examiner* — Stephen F Husar
*Assistant Examiner* — Meghan Dunwiddie

(57) ABSTRACT

An illumination device may include a hollow body having at least one light emission opening, wherein the hollow body has at least partly a reflective surface at its inner side, and at least one semiconductor luminous element, wherein a predominant portion of the light emitted by the semiconductor luminous element is incident on the inner side of the hollow body and is reflected from there through the light emission opening. The device may furthermore include a covering for the light emission opening with a grid-type arrangement of light transmission openings, wherein the at least one semiconductor luminous element is fixed to the covering and is directed at the inner side of the hollow body, and wherein a side area of the covering that surrounds the light transmission openings is at least partly reflectively coated.

16 Claims, 8 Drawing Sheets

U.S. PATENT DOCUMENTS

| | | | |
|---|---|---|---|
| 2006/0268544 | A1 | 11/2006 | Rains Jr. et al. |
| 2007/0189017 | A1 | 8/2007 | Hofmann |
| 2007/0268696 | A1 | 11/2007 | Scordino |

FOREIGN PATENT DOCUMENTS

| | | | |
|---|---|---|---|
| DE | 2459643 | A1 | 6/1976 |
| DE | 20002565 | U1 | 8/2001 |
| DE | 10105622 | A1 | 8/2002 |
| DE | 102007015475 | A1 | 5/2008 |
| EP | 0395802 | A1 | 11/1990 |
| KR | 20030067449 | A | 8/2003 |
| KR | 20080057564 | A | 6/2008 |
| WO | 2004097293 | A1 | 11/2004 |
| WO | 2005085706 | A1 | 9/2005 |
| WO | 2007054889 | A2 | 5/2007 |
| WO | 2009000536 | A1 | 12/2008 |

OTHER PUBLICATIONS

English abstract of KR 20080057564 A, May 12, 2011.
English maschine translation for DE 101 05 622 A1, Aug. 14, 2002.
English language abstract for WO 2004/097293 A1, Nov. 11, 2004.
English language abstract for WO 2009/000536 A1, Dec. 31, 2008.
International Search Report of PCT/EP2009/004889 mailed Oct. 15, 2009.
German Search Report of DE 10 2008 031 987.2 dated Oct. 5, 2010.
English translation of the International Preliminary Report on Patentability issued on Jan. 18, 2011.

ILLUMINATION DEVICE

RELATED APPLICATIONS

The present application is a national stage entry according to 35 U.S.C. §371 of PCT application No.: PCT/EP2009/004889 filed on Jul. 7, 2009, which claims priority from German application No.: 10 2008 031 987.2 filed on Jul. 7, 2008.

The invention relates to an illumination device, in particular an LED illumination device.

TECHNICAL FIELD

Background

When light-emitting diodes (LEDs) are used for general lighting, the problem occurs that an areal emission from a large luminous area is intended to be produced from the punctiform LEDs. The use of optical waveguides and/or transmission of the light emitted by the LEDs through diffuser plates has previously been known for this purpose. Optical waveguides have efficiencies of at most 50%, typical diffuser plates (e.g. GS060) approximately 40%. Therefore, known solutions are complex in terms of production and/or not very effective.

Moreover, there are often antiglare requirements. Thus, by way of example, for office lighting, as far as possible no light should be emitted more shallowly than at an angle of less than 30° with respect to the ceiling. Optical elements (prism plates, diaphragms, etc. in the case of illumination through diffuser plates) can be used for this purpose. Effective cooling of the LEDs without active elements (fans, etc.) is also expected.

SUMMARY

Various embodiments alleviate or even eliminate one or more of the problems discussed above in a comparatively simple and cost-effective manner.

The illumination device includes a hollow body having at least one light emission opening, wherein the hollow body has at least partly a reflective surface at its inner side. The illumination device furthermore includes at least one semiconductor luminous element, in particular an LED, wherein a predominant portion of the light emitted by the semiconductor luminous element is incident on the inner side of the hollow body - and hence also at least partly on the reflective surface - and is reflected subsequently through the at least one light emission opening.

Therefore, unlike hitherto, the at least one semiconductor luminous element does not emit in the main emission direction of the illumination device toward the outside, but rather emits predominantly into the hollow body and is reflected from there toward the outside. The reflection considerably expands the emission area in contrast to the substantially punctiform emission by the LEDs in the illumination device, thus resulting in a large-area emission area from the point of view of a user. As a result, the emission angle of the illumination device can be restricted, whilst maintaining a high light intensity, to an extent such that a glare effect can be precluded. Such a device can be realized inexpensively with the aid of simple elements.

Preference is given to an illumination device including a covering for the light emission opening with a grid-type arrangement of light transmission openings, wherein the at least one semiconductor luminous element is fixed to the covering and is directed at the inner side of the hollow body or into the hollow body. A particularly good efficiency is achieved as a result. In particular, a particularly large reflective luminous area is produced. In addition, the semiconductor luminous elements for further reduction of the glare effect are no longer directly evident.

For particularly homogeneous light distribution, the reflective surface has at least one diffusely reflective region. A significant gain in efficiency is achievable, moreover, since reflector films (e.g. available from Furukawa Electric) can reflect diffusely to the extent of more than 96%. Preferably, the reflective surface is completely diffusely reflective. Preferably, the free, inner surface of the hollow body is configured such that it is completely reflective.

For effective cooling of the semiconductor luminous elements it is preferred if the covering constitutes a heat sink for the at least one semiconductor luminous element. The at least one semiconductor luminous element is then connected in particular thermally conductively to the covering, preferably directly or via at least one highly thermally conductive layer. The covering is preferably produced from a highly thermally conductive material ($\lambda>15$ W/(m·K), in particular $\lambda>150$ W/(m·K)), in particular from a metal or a metal alloy, e.g. on a steel, copper and/or aluminum sheet.

For particularly simple limitation of the emission angle of the luminaire it is preferred if the covering is fashioned in the form of a rectangular or hexagonal lattice. The emission angle can then be set by way of the height or depth of the lattice. This then also results in a large heat emission area and, consequently, good heat dissipation from the light sources.

For simple configuration it is preferred if the covering is constructed from modules of identical form. The modules can be produced separately and then be connected or constitute imaginary subunits of an integral covering.

For complying with requirements with regard to a glare effect, in particular, it is preferred if light is emitted substantially at an emission angle of not more than 60° with respect to the main emission direction. This is equivalent to light not being emitted more shallowly than at an angle of 30° relative to a wall to which the luminaire is fixed.

In this case, it is particularly preferred if a ratio of a height of the light emission opening to a grid pitch is in the range of 1:2.

For achieving a high efficiency, preference is given to an illumination device wherein a side area of the covering that surrounds the light transmission openings is at least partly, in particular completely reflectively coated. As a result, in contrast to conventional diaphragms, no light is absorbed.

In this case, for attaining a high luminous intensity, it is particularly preferred if the light transmission opening substantially has a form of a parabolic concentrator.

The semiconductor luminous element preferably includes at least one light-emitting diode.

The use of a white emitting conversion LED may be preferred.

However, a use of different-colored LEDs may also be preferred, wherein the light of different colors is sufficiently mixed in particular during diffuse reflection. It is thereby possible to realize, inter alia, variable color loci or color temperatures in the sense of a "tunable white light source".

In order to increase the efficiency of a white illumination, it may be preferred if, instead of white conversion LEDs, blue LEDs are used on the covering, while the phosphor is situated at least on the rear wall, in particular on the entire or entire reflective area, the rear wall e.g. being coated with the phosphor (so-called "remote phosphor"). This affords the advantage that the phosphor does not become hot, as a result of which a loss of efficiency is avoided and back reflection of the blue light into the absorbent LED chips is significantly reduced.

However, it may also be preferred if, in particular wavelength-converted, LEDs having a color locus in the green region are used together with red emitting LEDs in order to obtain the desired color locus.

Consequently, it is generally preferred if a wavelength-converting phosphor is present on at least one part of the reflective surface, in particular a diffusely reflective surface.

For increasing the luminous efficiency it is preferred if the reflective surface is shaped such that it concentrates light emitted by the at least one semiconductor luminous element onto the associated light emission opening. For this purpose, the surface is preferably curved, in particular curved parabolically or in shell-shaped fashion, or shaped pyramidally.

The hollow body is preferably provided with ventilation holes for carrying away hot air, in particular in a rear wall lying opposite the light emission opening.

In order not to lose any light through the ventilation holes, it is preferred if the ventilation holes are provided with respective reflective coverings. The reflective coverings can be arranged within or outside the hollow body. The reflective coverings can be embodied such that they are planar or e.g. curved.

In order to reduce the structural height, it may be preferred if the LEDs are wide-angle LEDs, which therefore have a wide emission angle. These are available for example under the trade name "Golden Dragon Argus" in the form of lensed LEDs from OSRAM Opto Semiconductors. By means of the wide-angle LEDs, light is distributed more widely over a shorter distance at the rear wall.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
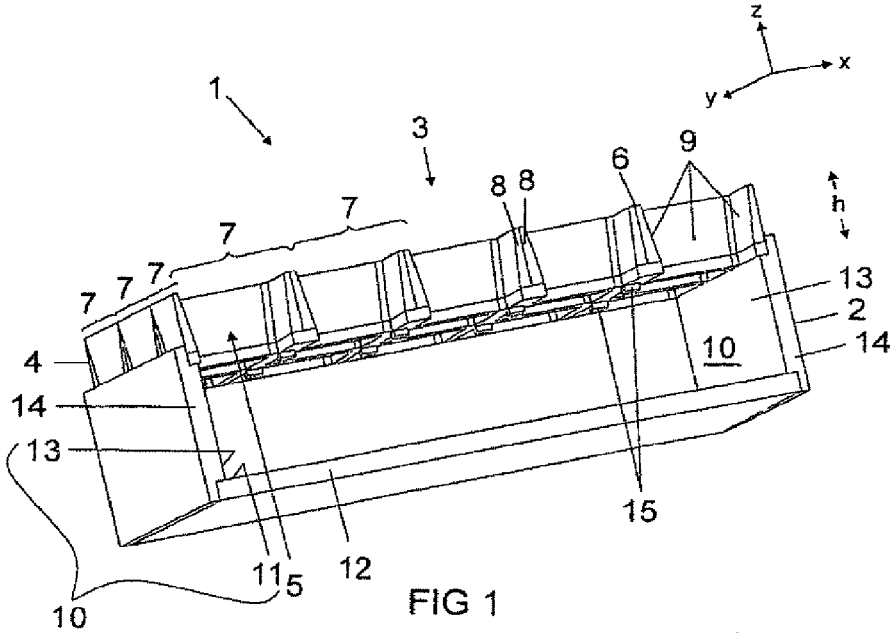
FIG. 1 shows an illumination device in accordance with a first embodiment as a sectional illustration in an oblique view.
Figure 2:
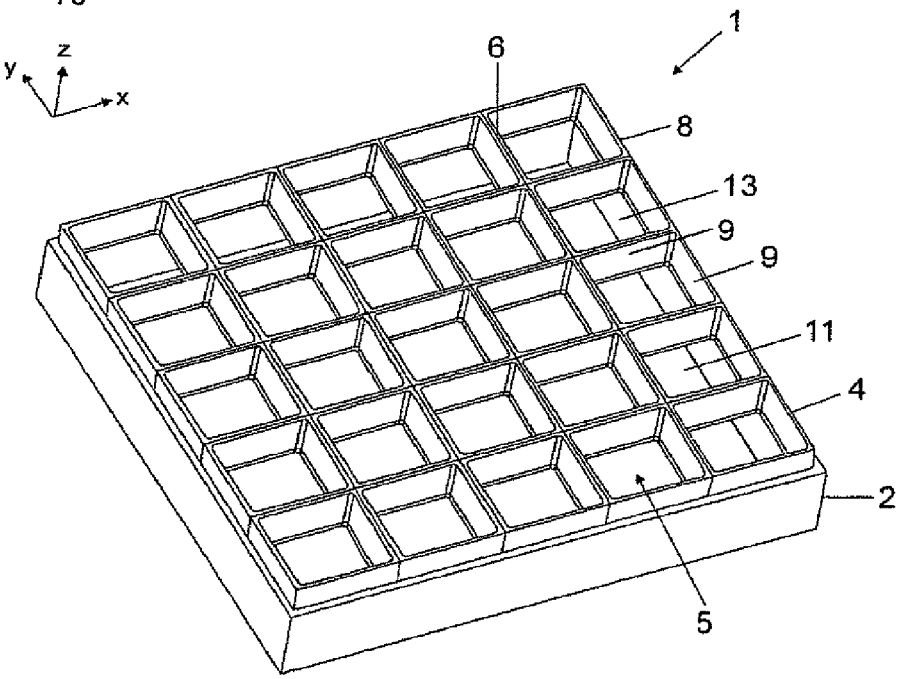
FIG. 2 shows the illumination device from FIG. 1 as an oblique view from above.
Figure 3:
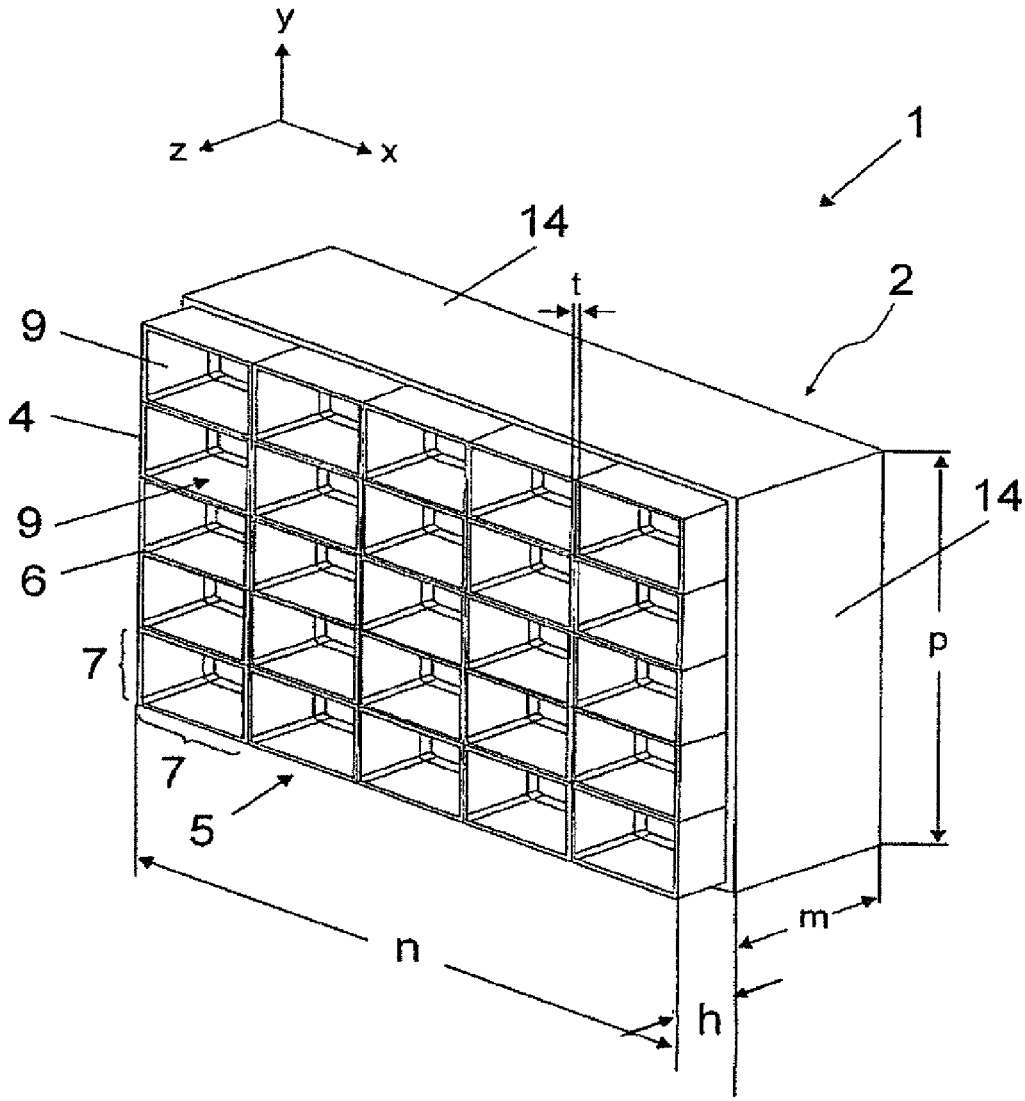
FIG. 3 shows the illumination device from FIG. 1 in a further oblique view.

Referring to FIG. 1, FIG. 2 and FIG. 3, an illumination device 1 includes a trough-shaped hollow body 2 having a hollow-parallelepipedal basic form, said hollow body being open at a top side 3. The top side 3 is covered by means of a mirror-grid-like covering 4. The covering 4 has a matrix-type arrangement of light transmission openings 5 of height h (in the z direction) each having a rectangular cross section (in the x-y plane). The covering 4 is therefore present in the form of a rectangular lattice having strips 6 of height h. The covering 4 can also be described as constructed from modules 7 (also see FIG. 5) of identical form which adjoin one another in a matrix-type manner; each of the modules 7 is then present as a box open on two sides (top side and underside) and having a circumferentially closed side wall having a rectangular outer contour. The inner areas 9 of the covering 4 or of the modules 7 which delimit the light transmission openings 5 are reflectively coated.

The inner wall 10 of the hollow body 2, namely an inside surface 11 of the rear wall 12 and inside surfaces 13 of the side walls 14, are configured as diffusely reflective by means of the application of a corresponding film (not illustrated in the figures). A suitable highly reflective diffuse film is available under the designation MC-PET from Furukawa Electric, for example. The rear wall 12 and the side walls 14 can then be lined with cut-to-size planar pieces of MC-PET on their inside surfaces 11, 13. Alternatively, the rear wall 12 and the side walls 14 may have e.g. a thermoformed Furukawa film as an individual shaped part.

On an underside of the covering 4, facing the hollow body 2 or the inner wall 10 thereof, white emitting conversion light-emitting diodes 15 are fitted at crossing points of strips 6 running transversely with respect to one another, or at mutually adjoining corners of the modules 7, in a highly thermally conductive manner such that their optical axis is directed straight downward (counter to the z axis) at the rear wall 12 and is thus directly opposite to the main emission direction of the illumination device 1, which points in the z direction. For good heat dissipation from the LEDs 15, the covering 4 includes an aluminum alloy.

Figure 6:
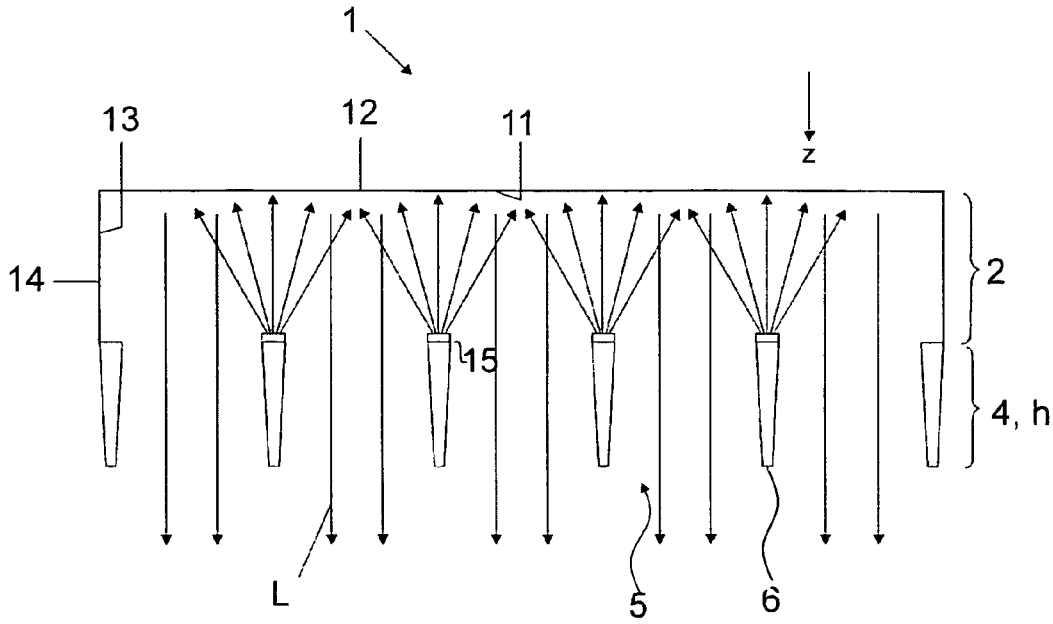
FIG. 6 shows a generalizing schematic diagram concerning the light reflection in the illumination device according to FIG. 1 as a sectional illustration in side view.

During operation, the light-emitting diodes 15 thus emit into the hollow body 2, as also depicted schematically in FIG. 6. This radiation is reflected at the reflective surface 11, 13 of said hollow body and projected further through the light transmission openings 5 of the covering, which together form a light emission opening of the illumination device 1. This can take place directly or by means of further reflection at the reflectively coated side areas 9 of the covering 4.

The spatial uniformity of the light emitted by the illumination device 1 is increased by the diffuse reflection. Moreover, color inhomogeneities can be reduced. The rear positioning of the LEDs 15 has the effect that an observer cannot look directly into the LEDs 15, which reduces a glare effect. A glare effect can also be reduced by a setting of the height h of the covering 4 and the form of the side areas 9 of the covering 4, as will be described in greater detail further below.

The hollow body 2 of the illumination device 1 has a height m (along the z direction) of 66 mm and, on both sides, an edge length p (along the x direction and y direction, respectively) of 258 mm. The covering 4 is constructed from modules 7 in a 5×5 matrix form and has a height h of 24.88 mm and an edge length n of 250 mm. The width t of the webs 6 is 3.82 mm and corresponds to double a wall thickness of the modules 7. The hollow body 2 forms an edge having the width r around the covering 4.

Figure 4:
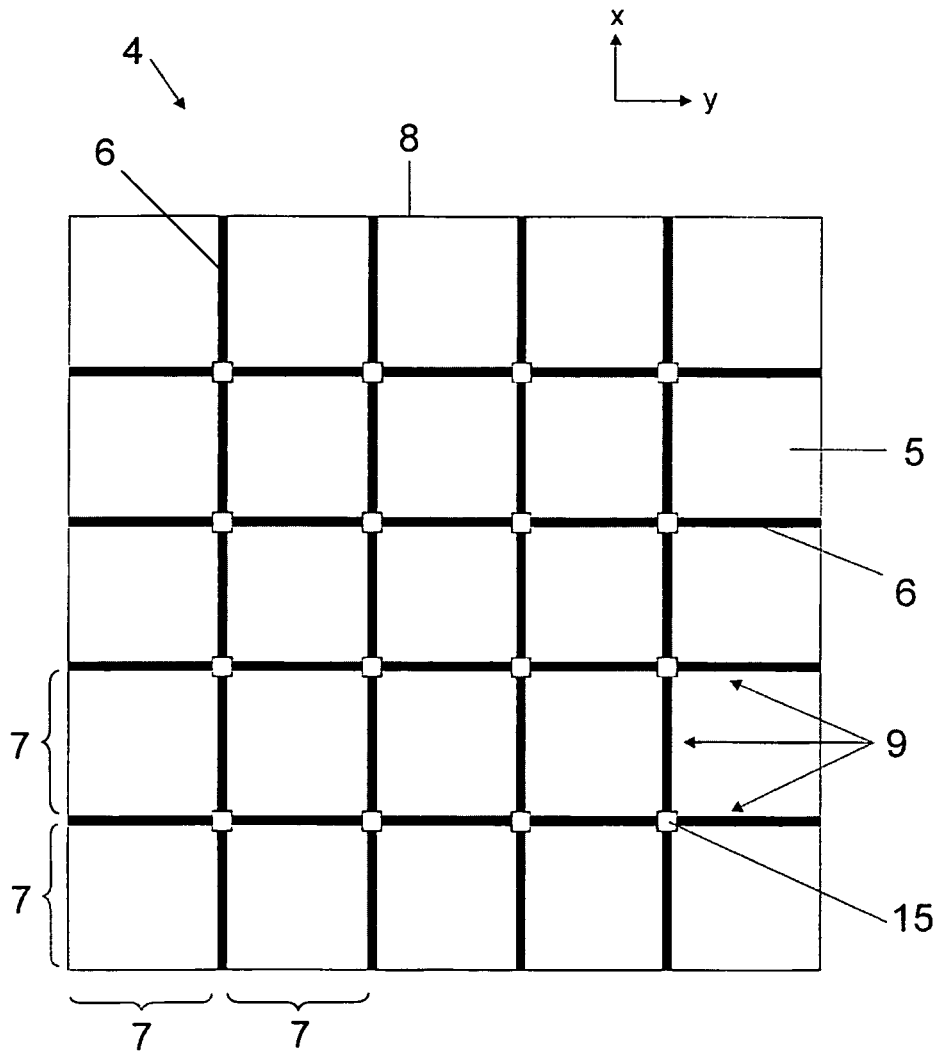
FIG. 4 shows a covering of the illumination device from FIG. 1 in a plan view from below.

FIG. 4 shows the covering 4 in a view from below of the side equipped with the LEDs 15. The LEDs 15 are arranged in a 4×4 matrix arrangement at inner crossing points of the struts 6. The light transmission openings 5 are analogously arranged in a 5×5 matrix form and have a square form in cross section (parallel to the x-y plane).

Figure 5:
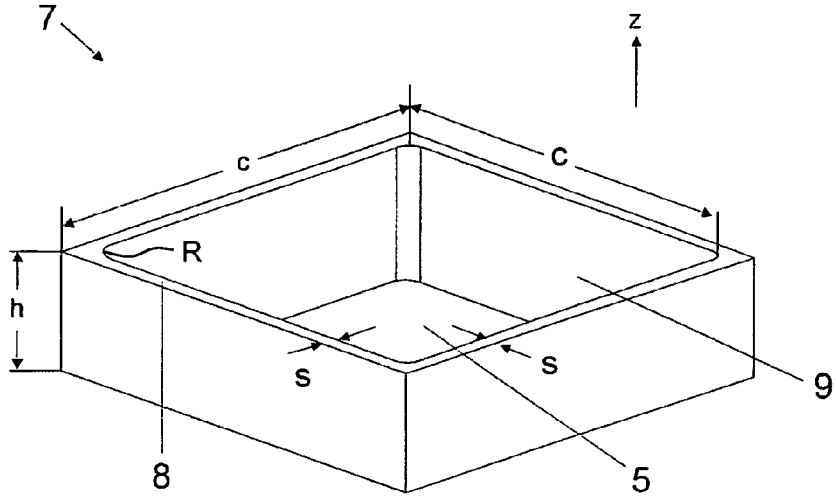
FIG. 5 shows a module of the covering from FIG. 4 in an oblique view.

FIG. 5 shows the module 7 of the covering as an individual part or excerpt with associated dimensional specifications. Although in practice the covering can be produced from a plurality of modules 7 which are produced separately and then connected in an areal fashion at their side walls 8, an integral configuration of the covering is preferred for the sake of simpler production; a module 7 is then an imaginary basic building block whose form and groupwise arrangement can be used to describe the covering. In the exemplary embodiment shown, the outer edge length (grid pitch) c of the module is 50 mm. The inner wall 9 is beveled into the depth and has an inner edge length s of 46.18 mm, corresponding to a wall thickness of 1.91 mm, at its wider (upper) opening and an inner edge length of 40 mm, corresponding to a wall thickness of 5 mm, at its narrower (lower) opening. The height h or depth of the module 7 along the z axis is 24.88 mm. The side walls 8 merge with one another at their inner wall 9 with a radius of curvature of 2 mm; alternatively, the side walls can run toward one another in pointed fashion.

FIG. 6 shows, as a sectional illustration in side view, a generalizing schematic diagram for illustrating the reflection of the light emitted by the LEDs 15 in the illumination device 1. The LEDs 15 radiate substantially onto the reflective surface 11 of the rear wall 12 of the trough 2, from where the light is reflected toward the outside through the openings 5 in the covering 4. Light rays impinging on the reflective surface 13 of the side wall 14 can either be reflected toward the outside through the openings 5 or, in the case of an excessively shallow angle, be reflected at the reflective side walls 9 of the struts 6 and subsequently be reflected toward the outside. By means of the arrangement shown, the emission angle from the covering 4 toward the outside can be limited in such a way, e.g. to 30° , that glare can be precluded.

Figure 7:
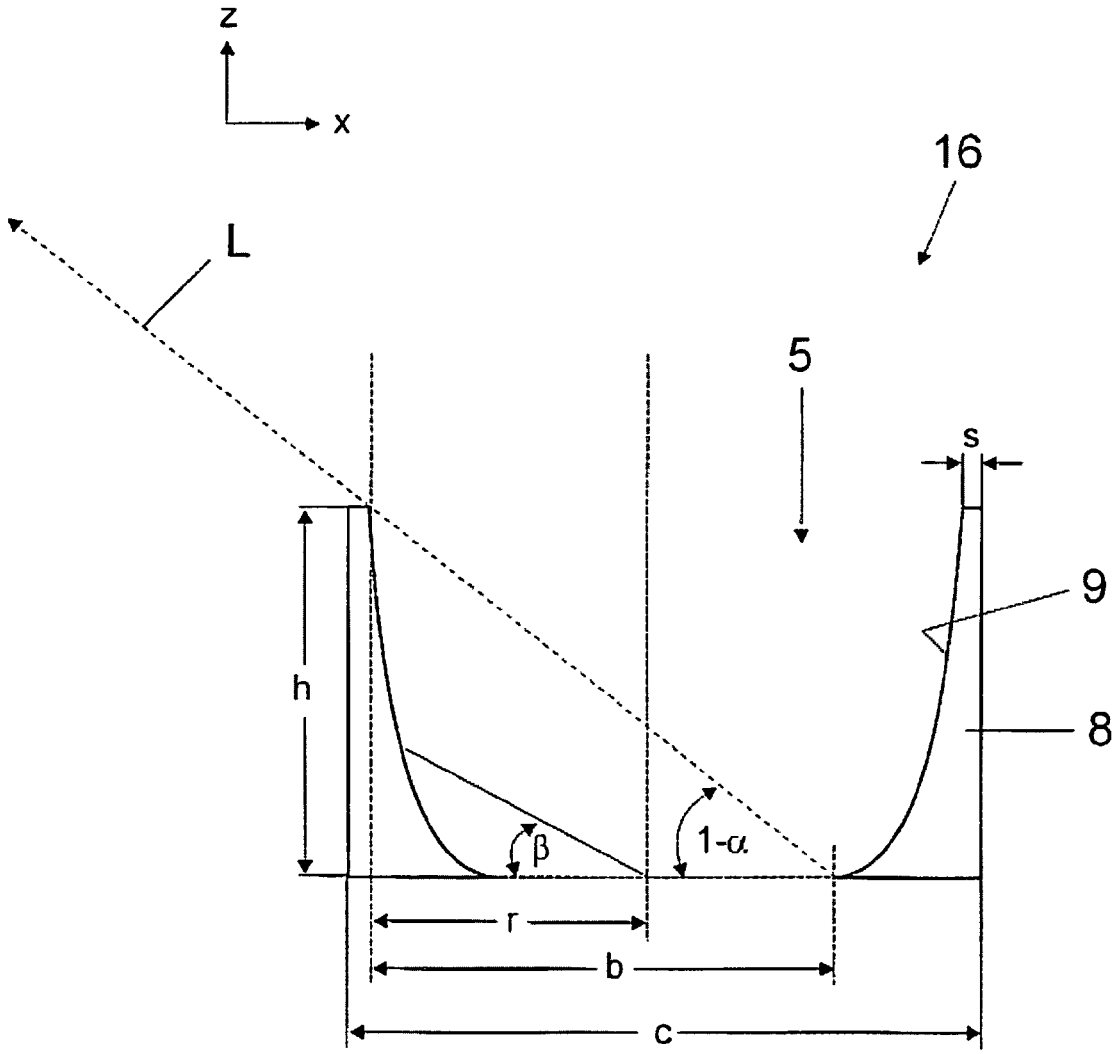
FIG. 7 schematically depicts a module in accordance with a further configuration.

FIG. 7 schematically depicts, in a sectional illustration in side view, a module 16 in accordance with a further embodiment as an imaginary basic building block of a covering. In contrast to the embodiment from FIG. 5, in which, for the sake of simpler production, the four inner, reflective side areas 17 were embodied as planar and slightly beveled, the reflective side area 17*b* is now present in the form of a parabolic concentrator. The area thereof in the embodiment shown is given by the parameterized equations:

$$x=2\cdot r\cdot(((1+\sin\alpha)\cdot\sin(\beta-\alpha))/(1-\cos\beta))-1) \quad (1)$$

$$y=2\cdot r\cdot((1+\sin\alpha)\cdot\cos(\beta-\alpha))/(1-\cos\beta) \quad (2)$$

The height h of the mirror grid or module 16 is chosen here such that suppression of glare is ensured, which is often formulated as the condition $$131\ \alpha>30° \quad (3)$$

This is equivalent to the condition that $$h>b\cdot\tan(1-\alpha)\approx b\cdot 0.577 \quad (4)$$

should hold true, where b represents the horizontal or lateral distance between a lateral position of the edge of the lower opening and an opposite lateral position of an edge of the upper opening of the light transmission opening 5 of the module 16 as shown. This results in an approximate ratio of height h to the edge length (grid pitch) c (typically 50 mm) including the wall thicknesses s (typically 2 mm) of 1 to 2, corresponding to h>23.1 mm.

What is achieved by means of this form of the side areas 9 of the light transmission opening 5 in the covering or in the module 16 is that a light ray incident from the hollow body on the reflective side areas 17*b* in shallow fashion is emitted at an angle 1-α of at most 30° with respect to the side, as indicated by the dashed arrow L.

In principle, depending on e.g. a desired brightness and the type of available LEDs, the grid pitch c can also be different, e.g. in the range of between 10 and 100 mm, etc. The form of the reflective side area 17 can also be embodied differently, e.g. in a manner curved only approximately parabolically or else differently, e.g. spherically or hyperbolically. The reflective side areas 17 can also be only slightly curved.

Figure 8:
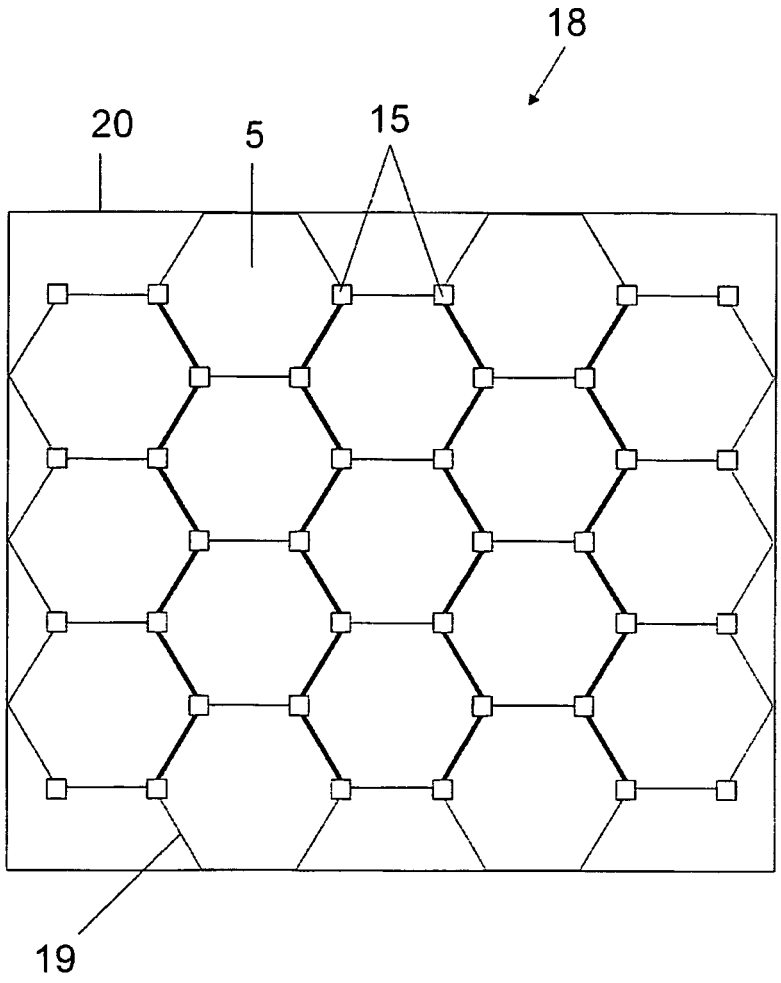
FIG. 8 shows a covering in accordance with a further embodiment in a plan view from below.

FIG. 8 shows, in a view analogous to FIG. 4, a covering 18 in accordance with a further configuration, which is now present as a hexagonal lattice. The covering 18 can be described as being composed of modules 19 having a hexagonal basic form (outer contour and inner contour), which are surrounded by a box-shaped frame 20. LEDs 15 are situated at the corners of the modules.

Figure 9:
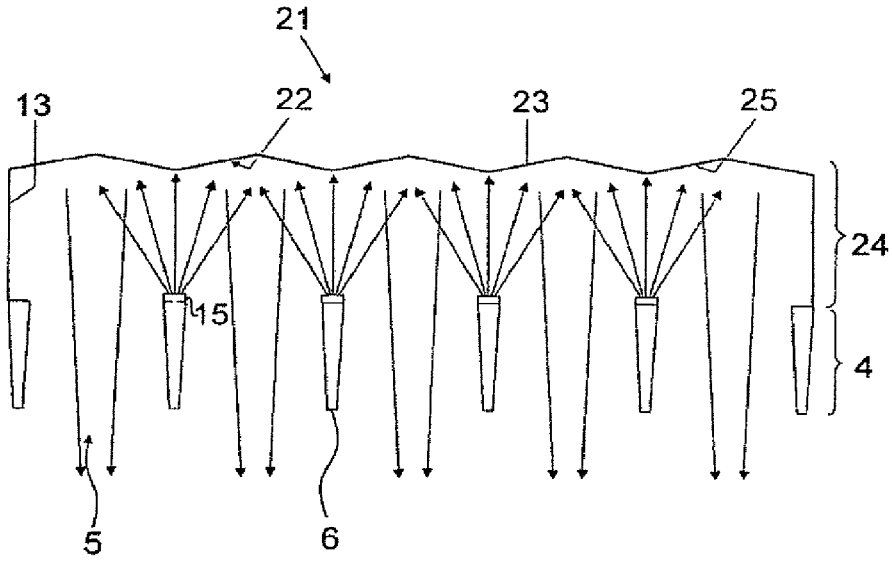
FIG. 9 shows a schematic diagram of an illumination device in accordance with yet another embodiment as a sectional illustration in side view.

FIG. 9 shows, in an illustration analogous to FIG. 6, an illumination device 21 in which now the inner side 22 of the rear wall 23 of the trough-shaped hollow body 24 is no longer embodied in planar fashion. Rather, the inner side 22 of the rear wall 23 has a plurality of mutually adjoining partial areas 25 (partial reflector areas) which concentrate the light emitted onto them by the LEDs 15 onto the transmission openings 5. For this purpose, such a partial reflector area 25 lies directly opposite each of the transmission openings 5. The partial reflector areas 25 each have a pyramidal surface contour or a rear wall having pyramidal angles. This increases the efficiency since light is reflected back from the walls to a lesser extent in the direction of the LEDs 15 and the underside of the covering 4.

Figure 10:
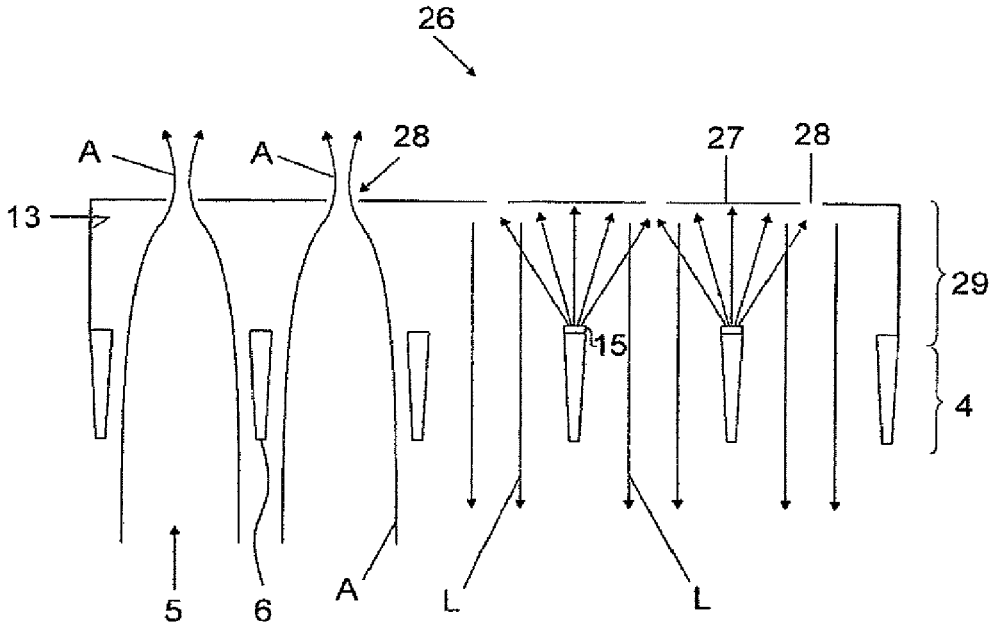
FIG. 10 shows a schematic diagram of an illumination device in accordance with yet another embodiment as a sectional illustration in side view.

FIG. 10 shows, in an illustration analogous to FIG. 6, an illumination device 26 in which ventilation openings 28 are now present in the rear wall 27. In the case of ceiling mounting, hot air A can thus be guided away upward from the illumination device 26, as indicated schematically for the two left-hand ventilation openings 28. As a result, firstly a cooling air flow A for cooling the covering 4 and, consequently, the LEDs thermally conductively connected thereto is produced, and secondly an accumulation of heated air in the hollow body 29 is avoided. Particularly in the case of suspended mounting of the luminaire 26, a chimney effect with significantly improved cooling arises.

Figure 11:
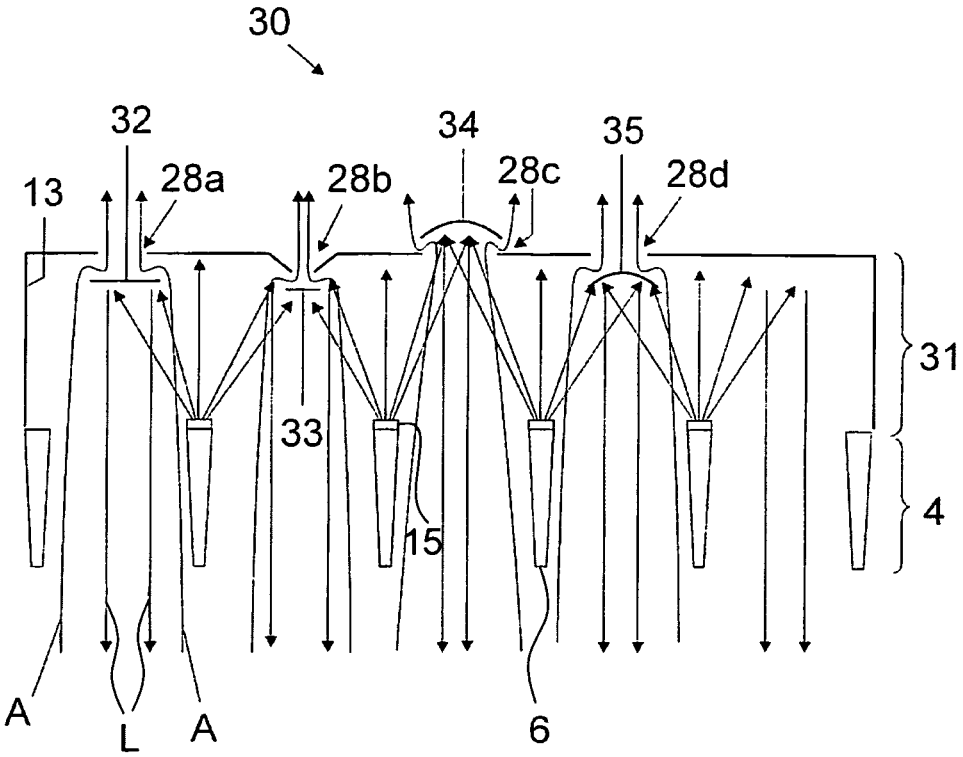
FIG. 11 shows a schematic diagram of an illumination device in accordance with yet another embodiment as a sectional illustration in side view.

FIG. 11 shows, in an illustration analogous to FIG. 10, an illumination device 30 in which now, in contrast to the embodiment in FIG. 10, a covering 32-35 which is reflective with respect to the LEDs 15 is fitted at (in front of or behind) each of the ventilation openings 28 or 28*a*-28*d* in order to reduce a loss of light through the ventilation openings 28. Ventilation openings and coverings 32-35 embodied differently in each case are shown here for the sake of simpler illustration.

Specifically, the covering 32 illustrated furthest on the left is embodied as a planar disk that covers the associated ventilation opening 28*a*. The area of the ventilation opening 28*a* which is oriented in the direction of the LEDs 15, and which is therefore opposite to the ventilation opening 28*a*, is reflective, preferably likewise diffusely reflective, in order to be able to reflect light rays impinging on it toward the outside through the openings 5.

In contrast thereto, the ventilation opening 28*b* arranged alongside on the right has an edge which is bent inward in the direction of the interior of the hollow body and which permits a smaller covering 33 than that shown on the far left. If appropriate, a covering can then even be dispensed with.

At the ventilation opening 28*c* arranged still further to the right thereof, a curved, in particular semicircularly or parabolically (convexly) shaped, reflectively coated covering 34 is provided on the outer side, said covering reflecting light rays passing toward the outside through the ventilation opening 28*c* back into the hollow body 31 again. The convex coverings can even contribute, in the case of a diffusive surface, to directing the light toward the front. Fitting on the outer side of the hollow body 31 has the advantage that the air flow of hot air out of the hollow body 31 is not impeded.

As shown with respect to the combination of 28*d* and covering 35 shown furthest on the right, the curved covering 35 can also be arranged in the hollow body 31.

It goes without saying that the present invention is not restricted to the exemplary embodiments shown.

Thus, instead of a white conversion LED, an LED module including a plurality of LED chips ("LED cluster") on a common substrate can also be present. The individual light-emitting diodes can in each case emit in a single color or in multicolored, e.g. white, fashion. Thus, an LED module may have a plurality of different-colored LED chips which together can produce a white mixed light, e.g. in "cold white" or "warm white". In order to generate a white mixed light, the LED cluster preferably includes light-emitting diodes which emit light in the primary colors red (R), green (G) and blue (B). In this case, individual or a plurality of colors can also be generated by a plurality of LEDs simultaneously; combinations RGB, RRGB, RGGB, RGBB, RGGBB, etc. are thus possible. However, the color combination is not restricted to R, G and B. In order to generate a warm-white hue, for example, one or a plurality of amber-colored LEDs "amber" (A) can also be present. In the case of LED chips having different colors, these can also be driven in such a way that the LED module emits in a tunable RGB color range. In order to generate a white light from a mixture of blue light with yellow light, it is also possible to use blue LED chips provided with phosphor, e.g. using surface mounting technology, e.g. using thin GaN technology. An LED module can then also have a plurality of white individual chips, as a result of which a simple scalability of the luminous flux can be achieved. The individual LED chips and/or the LED modules can be equipped with suitable optical units for beam guiding, e.g. Fresnel lenses, collimators, and so on. Instead of or in addition to inorganic light-emitting diodes, e.g. based on InGaN or AlInGaP, organic LEDs (OLEDs) can generally be used as well.

By way of example, in order to increase the efficiency, particularly in the case of white illumination, it may be preferred if, instead of white conversion LEDs in which blue emitter areas are provided with a wavelength conversion layer ("phosphor"), blue LEDs are used on the covering, while the phosphor is situated on the rear wall, in particular, the rear wall e.g. being coated with the phosphor (so-called "remote phosphor"). This affords the advantage that the phosphor does not become hot, as a result of which a loss of efficiency is avoided and back reflection of the blue light into the absorbent LED chips is significantly reduced.

However, a use of different-colored LEDs may also be preferred, wherein the light of different colors is sufficiently mixed in particular during diffuse reflection. It is thereby possible to realize, inter alia, variable color loci or color temperatures in the sense of a "tunable light source".

Thus, it is possible to use wavelength-converted LEDs having a color locus in the green region together with red-emitting LEDs in order to obtain the desired color locus. This likewise provides a gain in efficiency. In this case, too, the wavelength conversion material can be present as a "remote phosphor" on the reflective areas.

Moreover, the reflective areas need not reflect diffusely, but rather can reflect for example and in part diffusely, or not reflect diffusely.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE SYMBOLS

1 Illumination device
2 Hollow body
3 Top side
4 Covering
5 Light transmission opening
6 Strip
7 Module
8 Inner side wall of the module
9 Side area
10 Inner wall
11 Inside area
12 Rear wall
13 Inside area
14 Side wall
15 Light-emitting diode
16 Module
17 Side area
17*b* Side area
18 Covering
19 Module
20 Box-shaped frame
21 Illumination device
22 Inner side
23 Rear wall
24 Hollow body
25 Partial reflector area
26 Illumination device
27 Rear wall
28 Ventilation openings
28*a* Ventilation opening
28*b* Ventilation opening
28*c* Ventilation opening
28*d* Ventilation opening
29 Hollow body
30 Illumination device
31 Hollow body
32 Covering
33 Covering
34 Covering
35 Covering
A Air flow c Grid pitch
h Height of the covering
L Light ray
s Wall thickness

The invention claimed is:

1. An illumination device, comprising: a hollow body having at least one light emission opening, wherein the hollow body has at least partly a reflective surface at its inner side, and at least one semiconductor luminous element, wherein a predominant portion of the light emitted by the semiconductor luminous element is incident on the inner side of the hollow body and is reflected from there through the light emission opening, and furthermore comprising a covering for the light emission opening with a grid-type arrangement of light transmission openings, wherein the at least one semiconductor luminous element is fixed to the covering and is directed at the inner side of the hollow body, and wherein a side area of the covering that surrounds the light transmission openings is at least partly reflectively coated.

2. The illumination device as claimed in claim 1, wherein the reflective surface has at least one diffusely reflective region.

3. The illumination device as claimed in claim 1, wherein the covering constitutes a heat sink for the at least one semiconductor luminous element.

4. The illumination device as claimed in claim 1, wherein the covering is fashioned in the form of a rectangular or hexagonal lattice.

5. The illumination device as claimed in claim 1, wherein the covering is constructed from modules of identical form.

6. The illumination device as claimed in claim 1, wherein a ratio of a height of the light emission opening to a grid pitch is in the range of 1 to 2.

7. The illumination device as claimed in claim 1, wherein the light transmission opening substantially has a form of a parabolic concentrator.

8. The illumination device as claimed in claim 1, which is configured such that light is emitted from the illumination device substantially at an emission angle of not more than 60°.

9. The illumination device as claimed in claim 1, wherein the semiconductor luminous element comprises at least one light-emitting diode.

10. The illumination device as claimed in claim 9, wherein a wavelength-converting phosphor is present on at least one part of the diffusely reflective surface.

11. The illumination device as claimed in claim 1, wherein the reflective surface is shaped such that it concentrates light emitted by the at least one semiconductor luminous element onto the associated light emission opening.

12. The illumination device as claimed in claim 1, wherein the hollow body is provided with ventilation holes.

13. The illumination device as claimed in claim 12, wherein the ventilation holes are provided with respective reflective coverings.

14. The illumination device as claimed in claim 7, wherein a form of the light transmission opening is give by the equations $$x=2\cdot r\cdot(((1+\sin\alpha)\cdot(\sin(\beta-\alpha))/(1-\cos\beta))-1)$$

and $$y=2\cdot r\cdot((1+\sin\alpha)\cdot\cos(\beta-\alpha))/(1-\cos\beta).$$

15. The illumination device as claimed in claim 14, wherein: $1-\alpha>30°$ holds true.

16. The illumination device as claimed in claim 12, wherein the hollow body is provided with ventilation holes in a rear wall lying opposite the light emission opening.

* * * * *